United States Patent [19]

Borgmann et al.

[11] Patent Number: 4,998,422

[45] Date of Patent: Mar. 12, 1991

[54] REMOVABLE CORE PADLOCK WITH BOLT RETAINER

[75] Inventors: James W. Borgmann, Carmel; William R. Foshee, deceased, late of Indianapolis, both of Ind., by Carolyn S. Foshee, executrix

[73] Assignee: Best Lock Corporation, Indianapolis, Ind.

[21] Appl. No.: 400,817

[22] Filed: Aug. 30, 1989

[51] Int. Cl.[5] ..... E05B 67/22

[52] U.S. Cl. ..... 70/38 A; 70/367

[58] Field of Search ..... 70/38 R–38 C, 70/367–371

[56] References Cited

U.S. PATENT DOCUMENTS 2,759,350 8/1956 Swanson ..... 70/367 X 4,138,868 2/1979 Richards, Sr. ..... 70/38 A

*Primary Examiner*—Gary L. Smith

*Assistant Examiner*—Suzanne L. Dino

*Attorney, Agent, or Firm*—Barnes & Thornburg

[57] ABSTRACT

A padlock configured to accept a removable lock core is provided with a shackle and bolt mechanism for locking the shackle. The bolt mechanism is configured to be retainable in the padlock case during shipment of the padlock without its removable lock core. In addition, a tool is provided for releasing and removing the bolt mechanism easily from a secure position inside the padlock to disassemble the padlock for repair.

38 Claims, 3 Drawing Sheets

FIG. 1
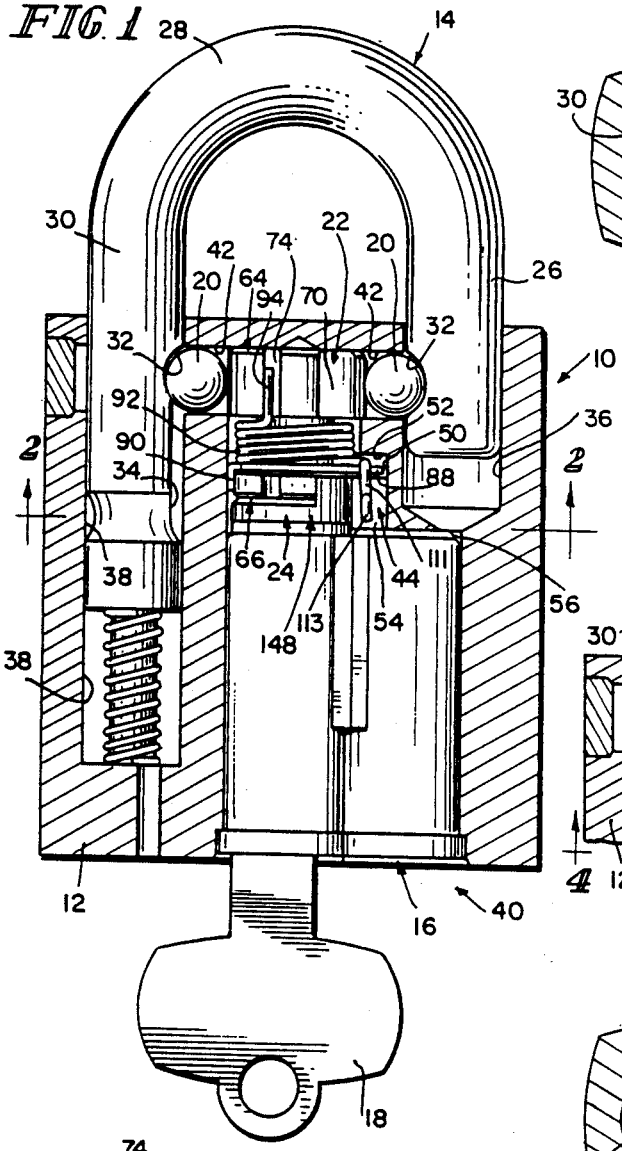
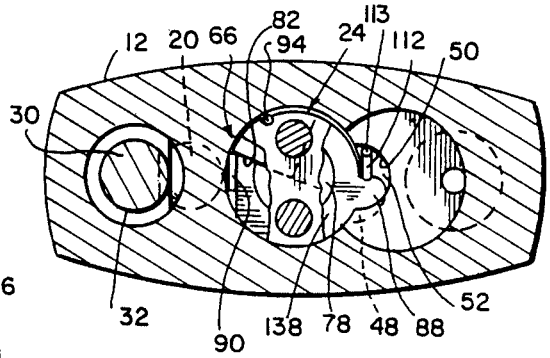
FIG. 2
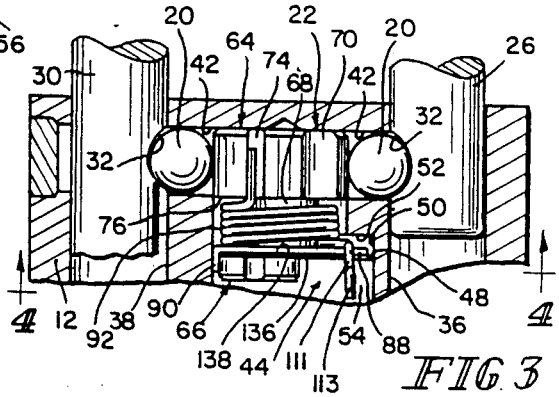
FIG. 3
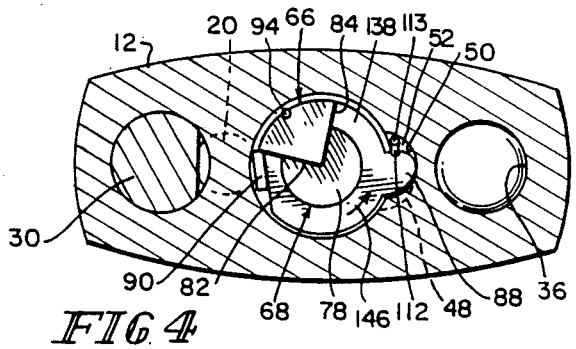
FIG. 4
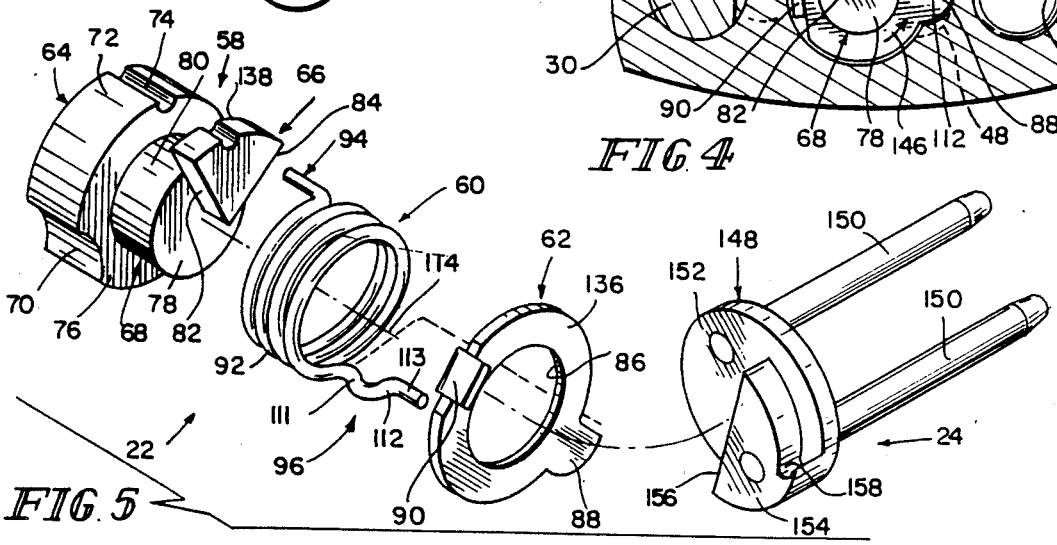
FIG. 5

FIG 6
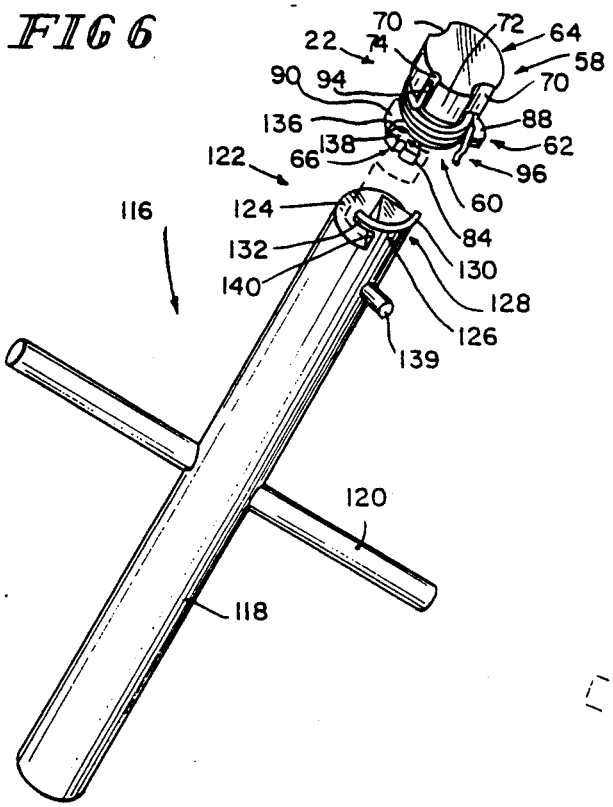
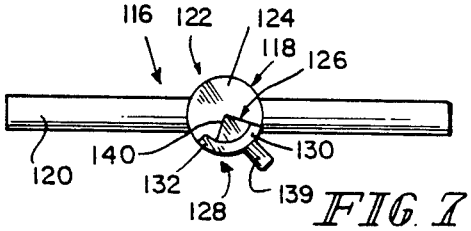
FIG. 7
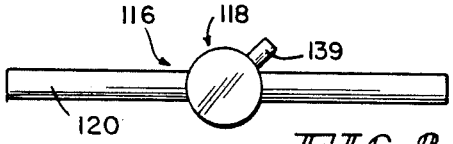
FIG. 8
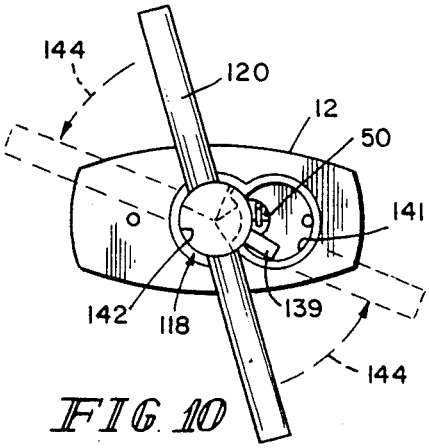
FIG. 10
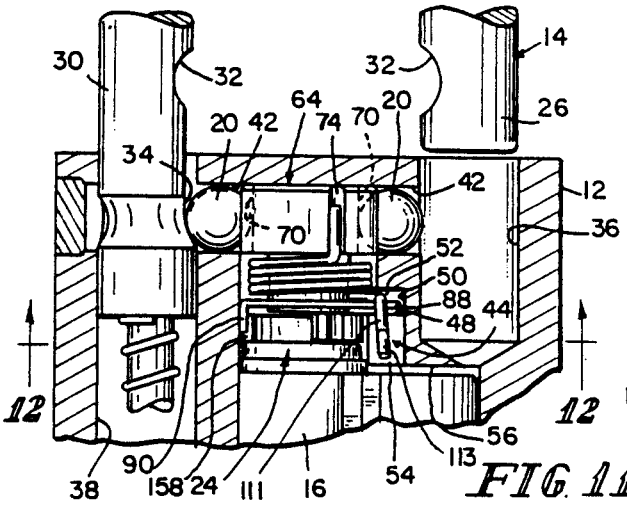
FIG. 11
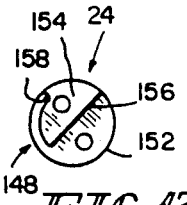
FIG. 13
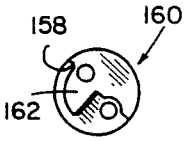
FIG. 14
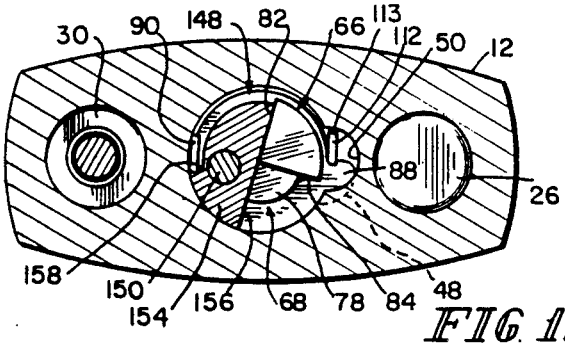
FIG. 12
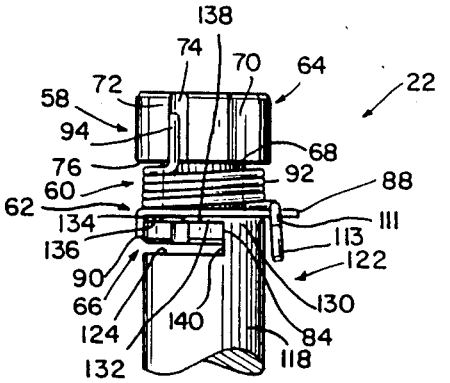
FIG. 9

REMOVABLE CORE PADLOCK WITH BOLT RETAINER

BACKGROUND AND SUMMARY OF THE INVENTION

This invention relates to padlocks, and particularly to a padlock having a lock cavity for receiving a removable lock core. More particularly, the present invention relates to a retainer assembly for keeping a shackle-locking bolt of the padlock in a retained position in the padlock while the lock cavity is empty of a removable core.

Padlocks configured to accept removable lock cores are typically shipped to a destination with a shackle and bolt mechanism for locking the shackle but without a lock core for actuating the bolt mechanism. In many instances, these removable lock cores are shipped to the destination independent of the padlocks that will ultimately house them. Typically, wadded paper, foam, or other filler is inserted into the empty core-receiving cavity in the padlock to prevent the bolt mechanism from falling out of the padlock through the cavity during shipment. This conventional practice is unsatisfactory because it could lead to loss of the bolt mechanism or potential damage to the bolt mechanism or its components.

One object of the present invention is to provide a bolt mechanism that is retainable or immobilized in a padlock case during shipment of the padlock without its removable lock core.

Another object of the present invention is to provide a tool for releasing and removing the bolt mechanism from a secure position inside the padlock to disassemble the padlock for repair. This tool could also be used easily to install the retainable bolt mechanism in a secure position inside the padlock to assemble the padlock for shipping.

Yet another object of the present invention is to control the maximum rotation-inducing torque that can be applied to a torsion spring that is used to bias a rotary lock-actuating bolt in a padlock to guard against overstressing such a torsion spring during unlocking of the padlock.

Still another object of the present invention is to provide a subassembly comprising a bolt and a bolt-biasing spring that is easily installed in and removed from a lock case using a single tool in a swift manner to simplify and refine the manufacturability and repairability of a lock containing the subassembly.

According to the present invention, a removable core padlock includes a lock case formed to include a lock cavity configured to receive a removable core and a bolt-receiving cavity in communication with the lock cavity. A shackle is movable between locked and open positions relative to the lock case. Means is provided in the lock case for locking the shackle in its locked position, which locking means is movable between a shackle-locking position and shackle-releasing positions.

Bolt means is provided in the bolt-receiving cavity for moving the locking means from its shackle-locking position to a shackle-releasing position. Such movement occurs in response to operation of a removable core installed in the lock cavity. First spring means is also provided for yieldably urging the bolt means relative to the lock case to a position establishing the shackle-locking position of the locking means.

The padlock further includes second spring means for yieldably urging a portion of the bolt means relative to the lock case into removal-blocking engagement with an inner wall of the lock case. Such engagement of the bolt means and the lock case causes the bolt means to be retained in the bolt-receiving cavity in a retained, substantially immobile position while the lock cavity is empty of a removable core.

In preferred embodiments of the present invention, the bolt means is rotatable about an axis relative to the lock case and against the first spring means to move the locking means to its shackle-releasing position. Further, the second spring means is aligned to yield in a direction orthogonal to the axis of rotation of the bolt means upon rotation of the bolt means during removal of the bolt means from the bolt-receiving cavity.

The first spring means is illustratively a torsion spring positioned yieldably to rotate the bolt means about its axis of rotation. The second spring means is illustratively a compression spring positioned yieldably to urge said portion of the bolt means into engagement with said inner wall of the lock case in a direction orthogonal to the axis of rotation of the bolt means. Preferably, the first spring means is integrally connected to the second spring means.

A tool is also provided for manipulating the bolt means in the lock case. The tool includes a shaft extendable into the lock cavity when empty of a removable core. Means is also provided on the shaft for rotating the bolt means against the compression spring in response to rotation of the shaft in the lock cavity. This action withdraws said portion of the bolt means from engagement with the inner wall of the lock case so that the bolt means is released from a trapped position within the lock case. The tool further includes means on the shaft for extracting the bolt means from the bolt-receiving cavity and lock cavity in response to withdrawal of the shank from the lock case.

One feature of the present invention is provision of second spring means for yieldably urging a portion of the bolt means into removal-blocking engagement with an inner wall of the lock case. Insertion and removal of the bolt means into and from the padlock case is facilitated because of the yieldable character of the second spring means. This feature permits a technician to move said portion of the bolt means against the second spring means during insertion or removal of the bolt means without disrupting the retainability of the bolt means in the padlock. Advantageously, the bolt means itself engages the padlock case to retain the bolt means therein while the lock cavity in the padlock is empty of a removable core during shipment without resorting to any extraneous cavity "filler" such as wadded paper or the like.

Another feature of the present invention is that the second spring means is integrally connected to first spring means provided in the padlock for yieldably urging the bolt means to a position establishing the shackle-locking position of locking means in the padlock. Manufacture and assembly of a padlock in accordance with such a preferred embodiment is greatly simplified because a single piece of spring material is configured to provide both a yieldable shackle-locking function and a bolt means-retaining function.

Yet another feature of the present invention is the provision of a tool for removal of the bolt means relative to the padlock case. The tool is advantageously configured to move the bolt means against the second spring means to release the bolt means from a trapped, substantially immobile position within the padlock case and also to extract the bolt means during withdrawal of the tool from the padlock case.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a longitudinal sectional view of a padlock embodying the present invention showing bolt means in a retained position and a removable lock core installed in the padlock;

FIG. 2 is a transverse sectional view of the padlock in FIG. 1, taken along lines 2—2 of FIG. 1, showing a portion of the bolt means being urged into an undercut chamber formed in the padlock case;

FIG. 3 is a view of the padlock illustrated in FIG. 1, with portions broken away, showing retention of the bolt means in an immobile position after removal of the lock core from the padlock;

FIG. 4 is a bottom plan view of the padlock illustrated in FIG. 3, taken along cut lines 4—4 of FIG. 3, showing an effect of rotation of the bolt means against a spring to release the portion of the bolt means from a trapped position in the padlock case;

FIG. 5 is an exploded, perspective assembly view illustrating components comprising the bolt mechanism and assembly of the bolt mechanism and a companion throw member which is connectable to a removable lock core;

FIG. 6 is a perspective view of a tool for use in connection with the padlock components illustrated in FIGS. 1-5;

FIG. 7 is a top end view of the tool of FIG. 6 showing the relative location of a stub finger, a drive wall, and a blocking pin;

FIG. 8 is a bottom end view of the tool of FIG. 6;

FIG. 9 is an enlarged, side elevational view of the elements of FIG. 6, with portions broken away, following assembly of the bolt mechanism subassembly onto the top end of the tool;

FIG. 10 is a bottom plan view of the padlock of FIG. 1 showing the tool of FIG. 6 inserted therein and illustrating rotatability of the tool relative to the lock case to move the bolt mechanism to its release position;

FIG. 11 is a view of the padlock illustrated in FIG. 1, with portions broken away, following rotation of the throw member and the rotary bolt to positions which the shackle is unlocked and spring-biased to its unlocked position;

FIG. 12 is a transverse sectional view of the padlock in FIG. 11, taken along lines 12—12 of FIG. 11, showing engagement of the throw member and a tab on the collar to limit rotation, of the throw member and rotary bolt relative to the lock case;

FIG. 13 is an end view of the throw member illustrated in FIG. 5 showing a roll-back cam configured to provide a non-key-retained throw member assembly;

FIG. 14 is an end view of another embodiment of a throw member showing a roll-back cam configured to provide a key-retained throw member assembly.

DETAILED DESCRIPTION OF THE DRAWINGS

Figure 15:
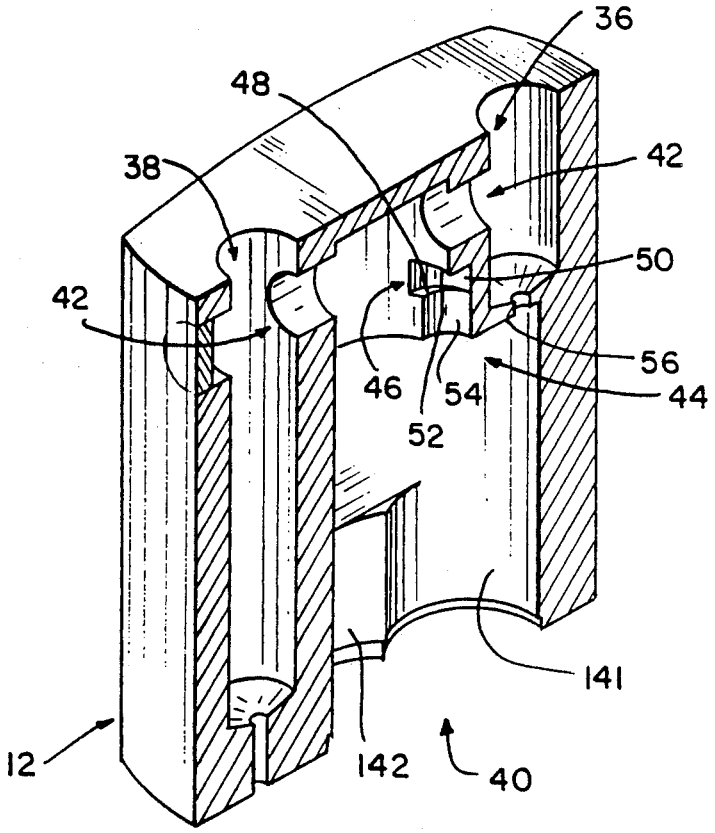
FIG. 15 is a perspective view of the padlock case of FIG. 1, with portions broken away, when the case is empty of all internal components.

The padlock 10 shown in the drawings comprises a lock case 12, a shackle 14, and a removable lock core 16 operable by means of a key 18. The padlock 10 further includes a pair of locking balls 20 for retaining the shackle 14 in a locked position within lock case 12, a bolt mechanism 22 for controlling the position of locking balls 20 relative to lock case 12, and a throw member 24 coupled to the core 16 for actuating the bolt mechanism 22.

The shackle 14 is generally a J-shaped bar with a toe leg 26, a bight 28, and a heel leg 30. Notches 32 are provided in toe leg 26 and heel leg 30 for receiving locking balls 20 as shown in FIG. 1 to retain shackle 14 in a locked position. A second notch 34 is provided in heel leg 30 to block removal of shackle 14 from lock case 12 as shown in FIG. 11.

The lock case 12 is a one-piece body that is formed to include spaced parallel bores 36 and 38 for the reception of the toe leg 26 and heel leg 30, respectively, of the shackle 14. A lock cavity 40 is formed in the lower end of the case 12 for the reception of removable lock core 16 as shown best in FIGS. 1 and 15. For example, a core of figure-8 cross section having a rotatable key plug therein would be satisfactory.

Upward from such cavity 40, lock case 12 is formed to include a pair of horizontally extending channels 42 for receiving locking balls 20 and a vertically extending bolt-receiving cavity 44 located in a central region of lock case 12. Bolt-receiving cavity 44 interconnects the lock cavity 40 and each of the ball-receiving channels 42 as shown best in FIGS. 1 and 15. Each channel 42 communicates with one of bores 36, 38 to permit each locking ball 20 to be urged by bolt mechanism 22 into one of the bores 36, 38 to engage a leg of shackle 14, thereby locking shackle 14 in lock case 12.

Interior regions of an empty lock case 12 are depicted in FIG. 15 to illustrate the manufacture of a preferred embodiment of the lock case 12 and several features thereof which permit the bolt mechanism 22 to be retained in a substantially immobile position within lock case 12 when the lock cavity 40 is empty of a removable lock core 16. Specifically, lock case 12 is formed to include an undercut 46 shown in FIG. 15 for receiving a portion 88 of the bolt mechanism 22 to retain the bolt mechanism 22 in lock case 12 in the manner shown in FIGS. 1-3.

Referring to FIGS. 1 and 15, undercut 46 communicates with bolt-receiving cavity 44 and is defined by drilling and milling lock case 12 to provide an arcuate ledge 48, a first annular side wall 50 extending upwardly from ledge 48, and overhanging top wall 52 appended to the top edge of side wall 50. A second annular side wall 54 depends from ledge 48 and extends downwardly to form a groove having a longitudinal opening in the first annular side wall 50 and a lower axial opening in top wall 56 of lock cavity 40.

Bolt mechanism 22 is rotatably mounted in bolt-receiving cavity 44 to control the position of locking balls 20 in channels 42. As shown in FIGS. 1 and 5, bolt mechanism 22 is a subassembly comprising a rotary bolt 58, a torsion spring 60, and a collar 62. Torsion spring 60 is configured and positioned in bolt-receiving cavity 44 to rotate rotary bolt 58 relative to lock case 12 to the position illustrated in FIG. 1. In that position, locking balls 20 are yieldably urged into locking engagement with notches 32 formed in shackle legs 26 and 30. Further, torsion spring 60 yieldably rotates collar 62 relative to the rotary bolt 58 to the "cocked" position illustrated best in FIGS. 1, 6, and 9 in which further rotation in the same direction is blocked.

Rotary bolt 58 includes a bolt head 64 at its upper end, a core-engaging lug 66 configured to be driven by throw member 24 at its lower end, and a spring hub 68 extending therebetween. Desirably, rotary bolt 58 is made of powdered metal to permit bolt 58 to be formed in a complex shape as a single part.

Bolt head 64 has a cylindrical shape and two concave annular release grooves 70 facing in opposite directions 180° apart about the exterior cylindrical surface 72 of bolt head 64. Grooves 70 are sized and shaped to receive a portion of the locking balls 20 when aligned in confronting relation to notches 32 to permit shackle 14 to be spring-biased to its released position. An axially extending slot 74 is formed in annular surface 72 as shown in FIGS. 1 and 5.

Spring hub 68 is a cylindrical member integrally connected to a bottom wall 76 of bolt head 64 and formed to have a diameter less than the diameter of bolt head 64. Spring hub 68 includes a bottom wall 78 having the core-engaging lug 66 appended thereto. Lug 66 is pie-shaped as shown best in FIG. 5 and appended to bottom wall 78 so that it extends in a radially outward direction beyond the exterior cylindrical wall 80 of spring hub 68 pie-shaped lug 66 includes a first face 82 driven by throw member 24 to transmit rotational movement of the throw member 24 to the rotary bolt 58. Lug 66 also includes a second face 84 employed to engage tool 116 so that rotary bolt 58 is rotated relative to lock case 12 during the process of removing bolt mechanism 22 from the bolt-receiving cavity 44.

Collar 62 is mounted for rotation about the cylindrical wall 80 of spring hub 68 and has a central aperture 86 for receiving spring hub 68 therethrough. Collar 62 also includes a radially outwardly projecting retainer lug 88 and an upstanding tab 90 as shown best in FIG. 5. As shown best in FIGS. 1 and 3, axial movement of collar 62 on spring hub 68 is limited by bolt head 64 and pie-shaped lug 66.

Torsion spring 60 includes a coil 92 disposed on spring hub 68 intermediate bolt head 64 and collar 62 so that coil 92 and lug 66 are on opposite sides of collar 62 as shown in FIG. 1. Coil 92 includes a first distal end 94 engaged in slot 74 of bolt head 64 and a second distal end 96 biased against retainer lug 88 of collar 62. Coil 92 yieldably rotates collar 62 relative to rotary bolt 58 an amount sufficient to urge tab 90 into engagement with the pie-shaped lug 66 so that rotation of collar 62 relative to rotary bolt 58 is limited. Essentially, collar 62 is biased to a pre-loaded position by torsion spring 60 so that bolt mechanism 22 is easily manipulated as a subassembly using a tool of the type described below without risk of disassembly of the bolt mechanism 22.

Second distal end 96 of coil 92 is configured to define means for yieldably urging retainer lug 88 of collar 62 into the undercut 46 formed in the lock case 12, as shown in FIGS. 2 and 15, thereby creating a barrier preventing removal of bolt mechanism 22 from bolt-receiving cavity 44 through lock cavity 40. Specifically, second distal end 96 includes first segment 111, second segment 112, and third segment 113 as shown best in FIG. 5.

Referring to FIGS. 1 and 2, it will be appreciated that the three segments 111, 112, and 113 are arranged in a serpentine shape to define a compression spring means. This spring means acts between first annular side wall 50 of undercut 46 and the edge of retainer lug 88 to urge retainer lug 88 into undercut 46 so that withdrawal of bolt mechanism 22 from bolt cavity 44 is blocked by engagement of retainer lug 88 and arcuate ledge 48. Thus, bolt mechanism 22 is retained in bolt-receiving cavity 44 in a substantially immobile position while lock cavity 40 is empty of a removable lock core 16 as shown in FIG. 3. This structure advantageously minimizes risk of losing or damaging bolt mechanism 22 during shipment of a padlock 10 without its removable core 16.

Referring to FIG. 5, first segment 111 extends away from coil 92 in substantially parallel relation to central axis 114 of coil 92. Second segment 112 is integrally connected to the distal end of first segment 111 and extends in substantially orthogonal relation to central axis 114. Third segment 113 is integrally connected to the distal end of second segment 112 and extends away from coil 92 in substantially parallel relation to central axis 114.

In use, first segment 111 is biased against retainer lug 88 by coil 92 to rotate collar 62 to its spring-loaded position wherein tab 90 engages pie-shaped lug 66 to block further rotation of collar 62 relative to rotary bolt 58. Upon installation of bolt mechanism 22 in bolt-receiving cavity 44, spring segments 111, 112, and 113 cooperate to urge retainer lug 88 into undercut 46 by acting between side wall 50 of lock case 112 and the edge of retainer lug 88.

Bolt head 64 is normally rotatably biased by torsion spring 60 acting between side wall 50 of lock case 12 and bolt head 64 to the position illustrated in FIG. 1. In this position, bolt head 64 urges locking balls 20 in radially outward directions in channels 42 into locking engagement with shackle 14. To unlock shackle 14, throw member 24 is rotated by turning key 18 in lock core 16 to rotate rotary bolt 58 relative to lock case 12 against torsion spring 60 to a position aligning release grooves 70 in bolt head 64 in confronting relation with notches 32 in shackle 14. Such alignment allows locking balls 20 to be cammed in radially inward directions in channels 42 during spring-biased movement of heel leg 30 in bore 38 from its locked position shown in FIG. 1 to its unlocked position shown in FIG. 11.

It will be appreciated that rotation of rotary bolt 58 against torsion spring 60 to unlock shackle 14 does not disrupt the spring-biased engagement of retainer lug 88 in undercut 46. Rotation of rotary bolt 58 in a shackle-unlocking direction (clockwise in FIGS. 2 and 4) tends to rotate collar 62 in the same angular direction because of engagement of first spring segment 111 and retainer lug 88. Such rotation of collar 62 acts to urge retainer lug 88 into undercut 46 and thus does not move the retainer lug in the opposite angular direction against spring segments 111, 112, and 113.

Referring to FIG. 6, a tool 116 is provided for carrying bolt mechanism 22 during removal of bolt mechanism 22 relative to lock case 12. Tool 116 includes a tubular shank 118 and a handle 120 affixed to shank 118 so that shank 118 is easily rotated about its longitudinal axis. Tool 116 will also carry bolt mechanism 22 if a user chooses to employ tool 116 to insert the bolt mechanism into the case.

At its distal end 122, tool 116 includes an end stub 126 depending from a bottom end wall 124 and an annular rim 128 as shown best in FIGS. 6 and 7. Annular rim 128 includes a proximal end 130 integrally connected to end stub 126 and a distal stub finger 132 circumferentially extending away from end stub 126 in vertically spaced relation to bottom end wall 124.

In another embodiment (not shown), the end stub of the tool is an arcuate wall of about the same radial thickness of proximal end 130 and distal stub finger 132 instead of a pie-shaped section as shown best for the end stub 126 in FIGS. 6 and 7. Nevertheless, such an end stub also includes a drive wall underneath the distal stub finger similar to drive wall 140 shown in FIGS. 6 and 7.

Referring to FIGS. 6 and 9, bolt mechanism 22 can be mounted on distal end 122 of tool 116 in a carrying position to simplify insertion of bolt mechanism 22 into bolt-receiving cavity 44 of lock case 12. Specifically, stub finger 132 is inserted into space 134 defined between a bottom wall 136 of collar 62 and an opposed top wall 138 of pie-shaped lug 66 on rotary bolt 58. The tool 116 is coupled to bolt mechanism 22 in the same manner during removal of bolt mechanism 22 from lock case 12.

A blocking pin 139 extends radially outwardly from shank 118 to align the bolt mechanism 22 in a proper orientation relative to undercut 46 during insertion of bolt mechanism 22 into bolt-receiving cavity 44. As shown in FIG. 10, blocking pin 139 fits into outer lobe chamber 141 only when shank 118 is rotated about its longitudinal axis to align blocking pin 139 in confronting relation to the open mouth of outer lobe chamber 141 prior to insertion of tool 116 into lock cavity 40.

Bolt mechanism 22 can be installed in padlock case 12 by hand or by mounting bolt mechanism 22 on the distal end 122 of tubular shank 118 and using tool 116 to deposit bolt mechanism 22 into bolt-receiving cavity 44. Tubular shank 118 is dimensioned to slide in inner lobe chamber 142 of lock cavity 40 with bolt mechanism 22 carried at its distal end 122 as long as shank 118 has been first rotated to permit entry of blocking pin 139 into outer lobe chamber 141. Third spring segment 113 contacts annular side wall 54 at some point during insertion of bolt mechanism 22 into bolt-receiving cavity 44. Third spring segment 113 acts to urge retainer lug 88 into undercut 46 as soon as retainer lug 88 is moved into confronting relation with the side opening of undercut 46. Once retainer lug 88 is spring-biased into undercut 46, removal of bolt mechanism 22 from bolt-receiving cavity 44 is blocked by engagement of retainer lug 88 and annular ledge 48.

Bolt mechanism 22 is easily removed from lock case 12 using tool 116. During disassembly, a slight downward pressure is applied by the user to tool 116 to provide better engagement between the tool 116 and bolt mechanism 22. As noted above, tool 116 can be rotated about its longitudinal axis in direction 144 as shown in FIG. 10 to cause drive wall 140 of end stub 126 to engage second face 84 of lug 66 to transmit rotary motion from tool 116 to bolt mechanism 22 during removal of bolt mechanism 22 from lock case 12. Essentially, the tool is used to rotate retainer lug 88 against the compression spring means 111, 112, and 113 as shown in FIG. 4.

It will be appreciated that rotation of pie-shaped lug 66 in a counterclockwise direction 146 as shown in FIG. 4 causes lug 66 to engage tab 90 of collar 62, thereby rotating retainer lug 88 in that same direction 146 to a released position outside of undercut 46. At this stage, a technician handling tool 116 can pull tool shank 118 bearing bolt mechanism 22 out of lock cavity 40 through inner lobe chamber 142 to withdraw bolt mechanism 22 easily from lock case 12.

The manner in which the throw member 24 is configured to guard against overstressing torsion spring 60 is illustrated in FIGS. 11-14. In effect, the maximum torque which can be applied to torsion spring 60 is controlled during unlocking of shackle 14 by limiting rotation of throw member 24 relative to padlock case 12 in response to rotation of key 18 in lock core 16.

An enlarged view of throw member 24 is provided in FIG. 5. Throw member 24 includes a roll-back cam 148 and a pair of downwardly extending legs 150 attached to roll-back cam 148. These legs 150 extend into lock core 16 in the conventional way and function to rotate roll-back cam 148 in response to rotation of key 18 in lock core 16.

Roll-back cam 148 includes a disk 152 dimensioned to fit in inner lobe 142 and bolt-receiving cavity 44 and a drive lug 154 integrally coupled to disk 152. Drive lug 154 includes a drive wall 156 configured to engage first face 82 of pie-shaped lug 66 to transmit rotary motion of throw member 24 to rotary bolt 58 during unlocking of shackle 14. Drive lug 154 further includes a recessed blocking wall 158 positioned to engage bolt mechanism 22 during rotation of throw member 24 in a shackle-unlocking direction to limit rotation of throw member 24 relative to padlock case 12.

Referring particularly to FIGS. 11 and 12, it will be seen that blocking wall 158 is located to engage tab 90 on collar 62 during rotation of throw member 24 to unlock shackle 14. Further rotation of throw member 24 is blocked upon engagement of blocking wall 158 and tab 90 because collar 62 is unable to rotate in that direction relative to padlock case 12 as a result of engagement of collar retainer lug 88 against first annular side wall 50 in undercut 46.

In operation, throw member 24 is rotated in a clockwise direction (FIG. 12) to rotate rotary bolt 58 in the same direction against torsion spring 60 by means of engagement of drive lug 154 on roll-back cam 148 and pie-shaped lug 66 on rotary bolt 58. Rotation of rotary bolt 58 may continue to rotate bolt head 64 to a position in which release grooves 70 are aligned in confronting relation with notches 32 in shackle legs 26 and 30. At this point, locking balls 20 are cammed inwardly to a release position shown in FIG. 11 by means of the upwardly biased heel leg 30. Continued rotation of throw member 24 relative to padlock case 12 past this "shackle unlocking point" is limited once blocking wall 158 of roll-back cam 148 engages the relatively fixed tab 90 on collar 62. Thus, the maximum torque that can be applied to torsion spring 60 is limited to guard against overstressing spring 60 during unlocking of the padlock 10.

The roll-back cam 148 shown in FIGS. 1, 5, 11, and 12 is illustrated in detail in FIG. 13. It will be appreciated by those skilled in the art that roll-back cam 148 is configured to provide a "non-key-retained" throw member assembly which provides sufficient lost motion to permit the operating key to be removable in the unlocked position of shackle 14.

An alternative embodiment of roll-back cam 148 is shown in FIG. 14. In that embodiment, a roll-back cam 160 is shown to include a modified drive lug 162 configured to provide a "key-retained" throw member assembly which retains operating key 18 in lock core 16 when the shackle 14 is in its unlocked position.

Although the invention has been described in detail with reference to certain preferred embodiments, variations and modifications exist within the scope and spirit of the invention as described and defined in the following claims.

What is claimed is:

1. A removable core padlock comprising a lock case formed to include a lock cavity configured to receive a removable core and a bolt-receiving cavity in communication with the lock cavity, a shackle movable between locked and open positions relative to the lock case, means in the lock case for locking the shackle in its locked position, the locking means being movable between a shackle-locking position and shackle-releasing positions, bolt means in the bolt-receiving cavity for moving the locking means from its shackle-locking position to a shackle-releasing position in response to operation of a removable core in the lock cavity, first spring means for yieldably urging the bolt means relative to the lock case to a position establishing the shackle-locking position of the locking means, and second spring means for yieldably urging a portion of the bolt means relative to the lock case into removal-blocking engagement with an inner wall of the lock case so that the bolt means is retained in the bolt-receiving cavity in a substantially immobile position while the lock cavity is empty of a removable core.

2. The padlock of claim 1, wherein the first spring means is integrally connected to the second spring means.

3. The padlock of claim 2, wherein the first spring means is a torsion spring having a first distal end acting against the bolt means and a second distal end acting against the lock case so that the bolt means is yieldably biased to move the locking means to its shackle-locking position, and the second distal end is formed to define the second spring means.

4. The padlock of claim 3, wherein the torsion spring further includes a coil formed about a central axis, the coil interconnects the first and second distal ends, and the second distal end is serpentine-shaped and configured to extend away from the coil in substantially parallel relation to the central axis of the coil.

5. The padlock of claim 3, wherein the torsion spring further includes a coil formed about a central axis, the coil interconnects the first and second distal ends, and the second distal end includes a first segment extending away from the coil in substantially parallel relation to the central axis of the coil, a second segment integrally connected to the distal end of the first segment and configured to extend in substantially orthogonal relation to the central axis of the coil, and a third segment integrally connected to the distal end of the second segment, and configured to extend away from the coil in substantially parallel relation to the central axis of the coil and act upon the lock case.

6. The padlock of claim 1, wherein the bolt means is rotatable about an axis relative to the lock case and against the first spring means to move the locking means to its shackle-releasing position, and the second spring means is aligned to yield in a direction orthogonal to the axis of rotation of the bolt means upon rotation of the bolt means during removal of the bolt means from the bolt-receiving cavity.

7. The padlock of claim 6, wherein the first spring means is a torsion spring positioned yieldably to rotate the bolt means about its axis of rotation and the second spring means is a compression spring positioned yieldably to urge said portion of the bolt means into engagement with said inner wall of the lock case in a direction orthogonal to the axis of rotation of the bolt means.

8. The padlock of claim 6, wherein the first spring means is integrally connected to the second spring means.

9. The padlock of claim 1, wherein the bolt means includes a rotary bolt and a collar mounted thereon for limited rotation relative to the rotary bolt, the first spring means acts between the rotary bolt and the collar yieldably to rotate the collar to an assembled position biased against a portion of the bolt means, the collar includes a retainer lug, and the second spring means acts between the lock case and the retainer lug to urge said portion of the bolt means into engagement with said inner wall of the lock case.

10. The padlock of claim 9 wherein the first spring means is integrally connected to the second spring means.

11. The padlock of claim 9, wherein the retainer lug includes said portion of the bolt means.

12. The padlock of claim 9, in combination with throw member means for rotating the bolt means relative to the lock case and against the first spring means to unlock the shackle, the throw member means being positioned in a removable core mounted in the lock cavity, the throw member means including means for engaging the collar during operation of the throw member means to limit further rotation of the bolt means relative to the lock case and against the first spring means so that the bolt means is prevented from applying a torque to the first spring means in excess of a predetermined torque.

13. The padlock of claim 1, in combination with a tool comprising a shaft extendable into the lock cavity when empty of a removable core and means on the shaft for rotating the bolt means against the second spring means to withdraw said portion of the bolt means from engagement with the inner wall of the lock case to release the bolt means from a trapped position within the lock case.

14. The combination of claim 13, wherein the tool further comprises means on the shaft for extracting the bolt means from the bolt-receiving cavity and lock cavity in response to withdrawal of the shank from the lock case.

15. A removable core padlock comprising a lock case formed to include a lock cavity configured to receive a removable core and a bolt-receiving cavity in communication with the lock cavity, the lock case being formed to include an interior end wall and side wall cooperating to define an undercut chamber situated in communication with the bolt-receiving cavity, a shackle movable between locked and open positions relative to the lock case, means in the lock case for releasably locking the shackle in its locked position, the locking means being movable between a shackle-locking position and shackle-releasing positions, bolt means in the bolt-receiving cavity for moving the locking means from its shackle-locking position to a shackle-releasing position in response to operation of a removable core in the lock cavity, and spring means acting between the bolt means and the lock case for yieldably urging a portion of the bolt means into the undercut chamber so that the portion of the bolt means lies in confronting relation to the interior end wall defining the undercut chamber to block egress of the bolt means from the bolt-receiving cavity through the lock cavity while the lock cavity is empty of a removable core.

16. The padlock of claim 15, wherein the bolt means is rotatably mounted in the bolt-receiving cavity, the spring means includes means for applying torque to the bolt means to rotate the bolt means relative to the lock case to a position establishing the shackle-locking position of the locking means and means for applying a force to move the portion of the bolt means into the undercut chamber so that the bolt means is retained in a substantially immobile position in the bolt-receiving cavity.

17. The padlock of claim 16, wherein the torque-applying means is a torsion spring having a first distal end acting against the bolt means and a second distal end acting against the lock case and the second distal end is configured to define the force-applying means.

18. The padlock of claim 17, wherein the second distal end of the torsion spring is a compression spring acting between the lock case and the portion of the bolt means.

19. The padlock of claim 16, wherein the bolt means includes a rotary bolt and a collar mounted thereon for rotation relative to the rotary bolt, the collar includes a retainer lug including said portion of the bolt means, the torque-applying means acts between the lock case and the rotary bolt, and the force-applying means acts between the lock case and the retainer lug.

20. The padlock of claim 19, wherein the rotary bolt includes a bolt head, a core-engaging lug, and a spring hub extending therebetween, and the torque-applying means includes a torsion spring having a coil disposed on the spring hub intermediate the bolt head and the core-engaging lug, a first distal end coupled to the bolt head, and a second distal end abutting an interior wall of the lock case.

21. The padlock of claim 19, wherein the rotary bolt includes a bolt head and a core-engaging lug, the collar further includes a tab, and the torque-applying means includes a torsion spring having a first distal end coupled to the bolt head, a second distal end abutting an interior wall of the lock case, and a knee member intermediate the first and second distal ends abutting the retainer lug and yieldably rotating the collar relative to the rotary bolt to urge the tab into engagement with the core-engaging lug to limit rotation of the collar relative to the rotary bolt.

22. The padlock of claim 15, in combination with a tool comprising a shaft extendable into the lock cavity when empty of a removable core and means on the shaft for rotating the bolt means against the spring means to retract the portion of the bolt means from the undercut chamber to release the bolt means from a trapped position within the lock case.

23. A removable core padlock comprising a lock case formed to include a lock cavity configured to receive a removable core and a bolt-receiving cavity in communication with the lock cavity, a shackle movable between locked and open positions relative to the lock case, means in the lock case for locking the shackle in its locked position, the locking means being movable between a shackle-locking position and shackle-releasing positions, a bolt mounted in the bolt-receiving cavity for rotation relative to the lock case to move the locking means from its shackle-locking position to a shackle-releasing position, a collar rotatably mounted on the bolt, the collar including a retainer lug, the lock case further including an interior wall defining a lug-receiving slot communicating with the bolt-receiving cavity, and a torsion spring having a first distal end coupled to the bolt and a second distal end positioned to abut another interior wall of the lock case, the second distal end being configured to define spring means acting between the another interior wall and the collar for yieldably urging the retainer lug in a predetermined direction into the lug-receiving slot and into rotation-blocking engagement with an interior surface of the slot so that the bolt is positioned relative to the lock case to establish the shackle-locking position of the locking means, and the bolt, collar, and torsion spring are retained in the bolt-receiving cavity in a substantially immobile position while the lock cavity is empty of a removable core.

24. The padlock of claim 23, in combination with throw member means for rotating the bolt means relative to the lock case and against the torsion spring to unlock the shackle, the throw member means being positioned in a removable core mounted in the lock cavity, the throw member means including means for engaging the collar during operation of the throw member means to limit further rotation of the bolt relative to the lock case and against the torsion spring so that the bolt is prevented from applying a torque to the torsion spring in excess of a predetermined torque.

25. The padlock of claim 23, wherein the bolt includes a bolt head communicating with the locking means, a core-engaging lug, and a spring hub extending therebetween, the torsion spring includes a coil interconnecting the first and second distal ends, and the coil is disposed around an exterior surface of the spring hub.

26. The padlock of claim 23, wherein the bolt includes a bolt head and a core-engaging lug, the collar further includes a tab, the first distal end of the torsion spring is coupled to the bolt head, and the torsion spring further includes a knee member intermediate the first and second distal ends abutting the retainer lug, the knee member applying a predetermined torque to rotate the collar relative to the bolt head so that the tab on the collar is moved to engage the core-engaging lug to limit further relative movement of the bolt and the collar.

27. The padlock of claim 26, in combination with throw member means for rotating the bolt means relative to the lock and against the torsion spring to unlock the shackle, the throw member means being positioned in a removable core mounted in the lock cavity, the throw member means including means for engaging the tab on the collar during operation of the throw member means to limit further rotation of the bolt relative to the lock case and against the torsion spring so that the bolt is prevented from applying a torque to the torsion spring in excess of a predetermined torque.

28. The padlock of claim 23, wherein the collar and the bolt cooperate to define a space therebetween opening into the lock cavity upon mounting the bolt in the bolt-receiving cavity, in combination with a tool comprising a shank configured to enter the lock cavity of the lock case when empty of a removable core, the shank including a finger and means for rotating the bolt relative to the lock case against the spring means upon rotation of the shank in a predetermined direction relative to the lock case so that the retainer lug is withdrawn from the lug-receiving slot, the finger is configured to enter said space between the bolt and the collar upon rotation of the shank relative to the bolt following predetermined compression of the spring means and engage a portion of the bolt so that an assembly comprising the bolt, the collar, and the torsion spring is withdrawn from the bolt-receiving cavity and lock cavity upon withdrawal of the shank from the lock case.

29. The combination of claim 28, wherein the bolt includes a bolt head communicating with the locking means, a core-engaging lug, and a spring hub extending therebetween, the collar is disposed around the spring hub, the torsion spring includes a coil interconnecting the first and second distal ends, the coil is disposed around the spring hub intermediate the bolt head and the collar, a top wall of the core-engaging lug and an opposite bottom wall of the collar cooperate to define said finger-receiving space, and the rotating means of the shank is positioned to engage the core-engaging lug upon rotation of the shank relative to the bolt to establish said rotation of the bolt relative to the lock case against the spring means during removal of said assembly from the lock case by means of the tool.

30. The combination of claim 29, wherein the shank is tubular and includes a bottom end wall and an end stub depending from the bottom end wall, the end stub includes a stop wall in spaced-apart parallel relation to the bottom end wall and a drive wall extending between the stop wall and the bottom end wall to define said rotating means, and the finger includes an annular guide wall which cooperates with the stop wall to receive a distal portion of the spring hub so that the bolt and shank are axially aligned in a predetermined orientation during rotation of the shank relative to the bolt.

31. An assembly for controlling actuation of shackle-locking members in a padlock having a lock cage, a lock cylinder, and a shackle movable relative to the lock case, the assembly comprising:

a bolt mounted in the lock case for rotation about a longitudinal axis to move the shackle-locking members from a shackle-locking position to a shackle-releasing position, a throw member connected between the lock cylinder and the bolt for rotating the bolt, and a torsion spring having a first distal end coupled to the bolt, a second distal end configured to be coupled to the lock case, and a coil interconnecting the first and second distal ends, the coil being disposed about an exterior surface of the bolt.

32. The assembly of claim 31 wherein the bolt includes means for retaining the coil on the exterior surface of the bolt so that the bolt and torsion spring form a subassembly that is movable as a unit during assembly and disassembly of a padlock.

33. The assembly of claim 32, wherein the bolt includes a bolt head communicating with the shackle-locking members, a core-engaging lug, and a spring hub extending therebetween, the coil is disposed around an exterior surface of the spring hub, and the bolt head and core-engaging lug extend in a radially outward direction relative to the longitudinal axis of the bolt to define said retaining means.

34. The assembly of claim 29, further comprising a collar rotatably mounted on the bolt, means for yieldably biasing the collar to a position fixed with respect to the lock case, and cam means for rotating the bolt relative to the lock case and against the torsion spring to a predetermined position corresponding to the shackle-releasing position of the shackle-locking members, the cam means being mounted for rotation relative to the lock case and including means for engaging a portion of the collar while the collar is in its fixed position upon a predetermined amount of rotation of the cam means relative to the lock case so that rotation of the bolt means relative to the lock case is limited to a maximum amount during rotation of the cam means, thereby preventing overstressing of the torsion spring.

35. The assembly of claim 31, further comprising a collar rotatably mounted on the bolt, the collar including a tab, the bolt including a core-engaging lug, the torsion spring including means for yieldably rotating the collar relative to the bolt to urge the tab into engagement with the core-engaging lug to limit rotation of the collar relative to the bolt.

36. The assembly of claim 35, wherein the collar includes lug means for engaging the lock case limit rotation of the collar relative to the lock case and further comprising means for yieldably biasing the collar to cause the lug means to engage the lock case and maintain the collar in a fixed position and cam means for rotating the bolt relative to the lock case against the torsion spring to a predetermined position corresponding to the shackle-releasing position of the shackle-locking members, the cam means being mounted for rotation relative to the lock case and including a drive lug including a drive wall configured to engage the core-engaging lug to transmit rotation of the cam means to the bolt and a tab-blocking wall configured to engage the tab to block further rotation of the cam means upon rotation of the collar to its fixed position, thereby aiding in preventing overstressing of the torsion spring during operation of the cam means

37. The assembly of claim 36, wherein the torsion spring is configured to provide the biasing means

38. A removable core padlock comprising a lock case formed to include a lock cavity configured to receive a removable core and a bolt-receiving cavity in communication with the lock cavity, a blocking member disposed in the bolt-receiving cavity, the blocking member including a lug engaging an inner wall of the bolt-receiving cavity to block rotation of the blocking member relative to the lock case in a first direction, a shackle movable between locked and open positions relative to the lock case, means in the lock case for locking the shackle in its locked position, the locking means being movable between a shackle-locking position and shackle-releasing positions, bolt means in the bolt-receiving cavity for moving the locking means from its shackle-locking position to a shackle-releasing position in response to operation of a removable core in the lock cavity, spring means for yieldably urging the bolt means relative to the lock case to a position establishing the shackle-locking position of the locking means, and throw member means in the removable core for rotating the bolt means in said first direction relative to the lock case and against the spring means to unlock the shackle, the throw member means including means for engaging the fixed blocking member following rotation of the bolt means to move the locking means to its shackle-releasing position so that further operation of the throw member means to rotate the bolt means in said first direction against the spring means is prevented, thereby limiting the torque applied spring means to a maximum torque.

* * * * *